US005417028A

United States Patent [19]

Meyer

[11] Patent Number: 5,417,028

[45] Date of Patent: May 23, 1995

[54] ROOF TRUSS AND BEAM THEREFOR

[75] Inventor: Dolph A. Meyer, Carlingford, Australia

[73] Assignee: Uniframes Holdings Pty. Ltd., Smithfield, Australia

[21] Appl. No.: 989,940

[22] Filed: Dec. 10, 1992

Related U.S. Application Data

[63] Continuation-in-part of Ser. No. 449,967, Jun. 14, 1988, Pat. No. 4,986,051, and a continuation of Ser. No. 592,139, Oct. 3, 1990.

[30] Foreign Application Priority Data

Jun. 12, 1987 [AU] Australia ..... PI2444
Jun. 14, 1988 [WO] WIPO ..... PCT/AU88/00188
Oct. 3, 1989 [AU] Australia ..... PJ6675

[51] Int. Cl.[6] ..... E04C 3/30

[52] U.S. Cl. ..... 52/738; 52/693; 52/832.1

[58] Field of Search ..... 52/336, 737, 738, 739, 52/334, 691, 694, 450, 639, 644, 693; 428/596, 597, 599, 600

[56] References Cited

U.S. PATENT DOCUMENTS

| | | | |
|---|---|---|---|
| 3,018,862 | 1/1962 | Litteral et al. | 52/690 |
| 3,812,636 | 5/1974 | Albrecht et al. | 52/221 X |
| 4,144,369 | 3/1979 | Wass | 52/334 |
| 4,329,824 | 5/1982 | Lowe | 52/738 |
| 4,579,785 | 4/1986 | Karoubas | 52/334 |
| 4,593,506 | 6/1986 | Hartman et al. | 52/221 |
| 4,741,134 | 5/1988 | Stohs | 52/221 |
| 4,781,001 | 11/1988 | Ryan | 52/221 X |
| 4,962,622 | 10/1990 | Albrecht et al. | 52/221 X |
| 4,986,051 | 1/1991 | Meyer et al. | 52/738 |

FOREIGN PATENT DOCUMENTS

| | | | |
|---|---|---|---|
| 2339638 | 2/1975 | Germany | 52/336 |
| 8809854 | 12/1988 | WIPO | 52/639 |

*Primary Examiner*—Carl D. Friedman
*Assistant Examiner*—Kien Nguyen
*Attorney, Agent, or Firm*—Ladas & Parry

[57] ABSTRACT

A top chord for a roof truss, the top chord has a cross section so that the chord has a top web joining to side flanges. The side flanges have converging flange portions which are corrugated so as to have corrugations extending away from the web.

6 Claims, 4 Drawing Sheets

ROOF TRUSS AND BEAM THEREFOR

This is a continuation in part of our U.S. application 07/449,967 filed Jun. 14, 1988 (now U.S. Pat. No. 4,986,051 issued Jan. 22, 1991) and International Application PCT/AU89/00188 filed Jun. 14, 1988 and a continuation of U.S. application Ser. No. 07/592,139 filed Oct. 3, 1990.

This invention relates to structural beams principally used in roof trusses for the building industry.

Presently, the most common form of roof trusses are constructed using timber members being of rectangular section. Recently there has been renewed interest in steel frames houses which utilize steel members of various forms in their construction.

Timber truss members can be disadvantageous due to (1) the initial material cost.

(2) cost of subsequent processing to construct the desired truss.

(3) the inefficient use of the material which is usually limited to square or rectangular sections thus causing the strength/cost ratio to be decreased.

(4) the effect of warpage distortion, shrinkage and decay (e.g. wood rot) due to environmental conditions.

(5) the possibility of insect infestation such as termites or borers.

(6) possible damage caused by transportation of pre assembled roof trusses due to their unstable nature in this form.

Hence the abovementioned disadvantages have prompted efforts in the development of steel roof truss construction, which if appropriately designed, can result in a superior product.

Steel roof trusses are advantageous due to:

(1) the vast nature of steel production makes it relatively cheap.

(2) an efficient design can afford itself to continuous production methods hence reducing cost.

(3) the material can be formed into any desired geometrical shape thus providing the possibility of increased strength/cost ratio.

(4) no warpage, distortion or shrinkage occurs with steel due to the environment. Decay of steel (e.g. rust) is a problem with raw steel, however, galvanizing negates this attack. Additionally, galvanized steel, if produced on a continuous basis, is still relatively cheap compared to timber material costs.

(5) steel is not affected by insect infestation.

(6) pre assembled steel roof trusses are inherently more rigid than their timber counterparts and as such afford themselves to safe transportation.

In typical roof truss design the top chord member is essentially a beam, which due to its operational characteristics, becomes the critical item in roof truss design.

A number of steel roof truss designs have been produced and are presently commercially available. In their construction, the top chord members have been designed in a variety of forms in an attempt to increase the strength/cost ratio. However this has not been achieved to the degree required.

The present invention is a modification and improvement of the upper chord beam disclosed in International Application No PCT/AU88/00188 (international publication number WO 88/09854).

It is the object of the present invention to overcome or substantially ameliorate the above disadvantages.

There is disclosed herein a structural beam formed of rolled metal strip material having a cross section so that the beam has a longitudinally extending web, a pair of parallel side flanges joined by said web, each side flange having a first flange portion which is generally perpendicular to said web, so that the two first flange portions are generally parallel and spaced by a distance less than the transverse width of the web, and a second flange portion which is inclined to both the web and the associated first flange portion, so that the second flange flanged portions converge away from said web toward the first flange portions, and wherein the second flanged portions are corrugated so as to provide corrugations extending in a direction from said web towards the associated first flange portion.

A preferred form of the present invention will now be described by way of example with reference to the accompanying drawings wherein FIGS. 1 and 2, are schematic elevations of typical forms of a roof truss;

Figure 1:
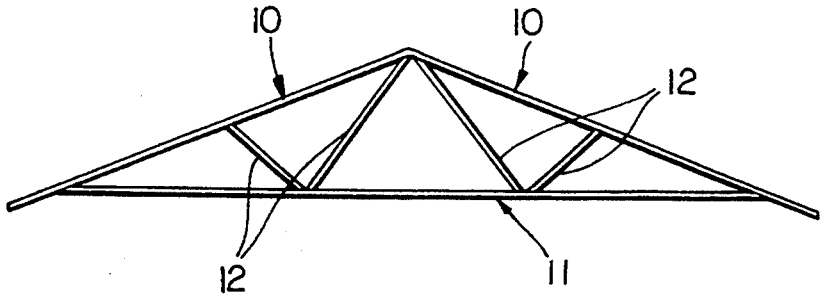
Figure 2:
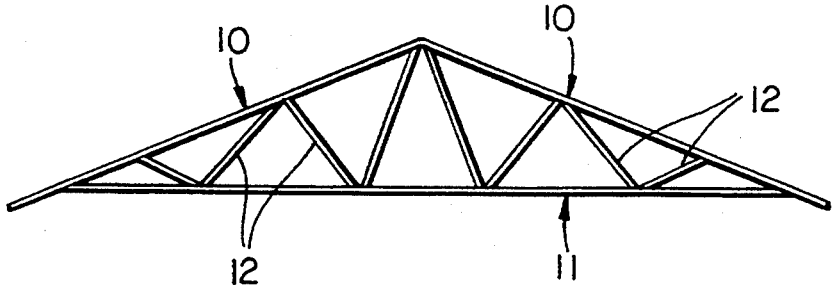

In FIGS. 1 and 2 of the accompanying drawings there is schematically depicted typical roof truss designs consisting of a bottom chord 11, a top chord 10, and web members 12.

The top chord 10, when stressed in conformance with normal loading situations, supports both bending moments and axial compression forces. Typically the bending forces are significantly greater than the compression forces.

The top chord of any roof truss is a critical item as it undergoes the greatest stress loading and must transmit the operational loads to the remaining truss members.

Figures 3, 3A:
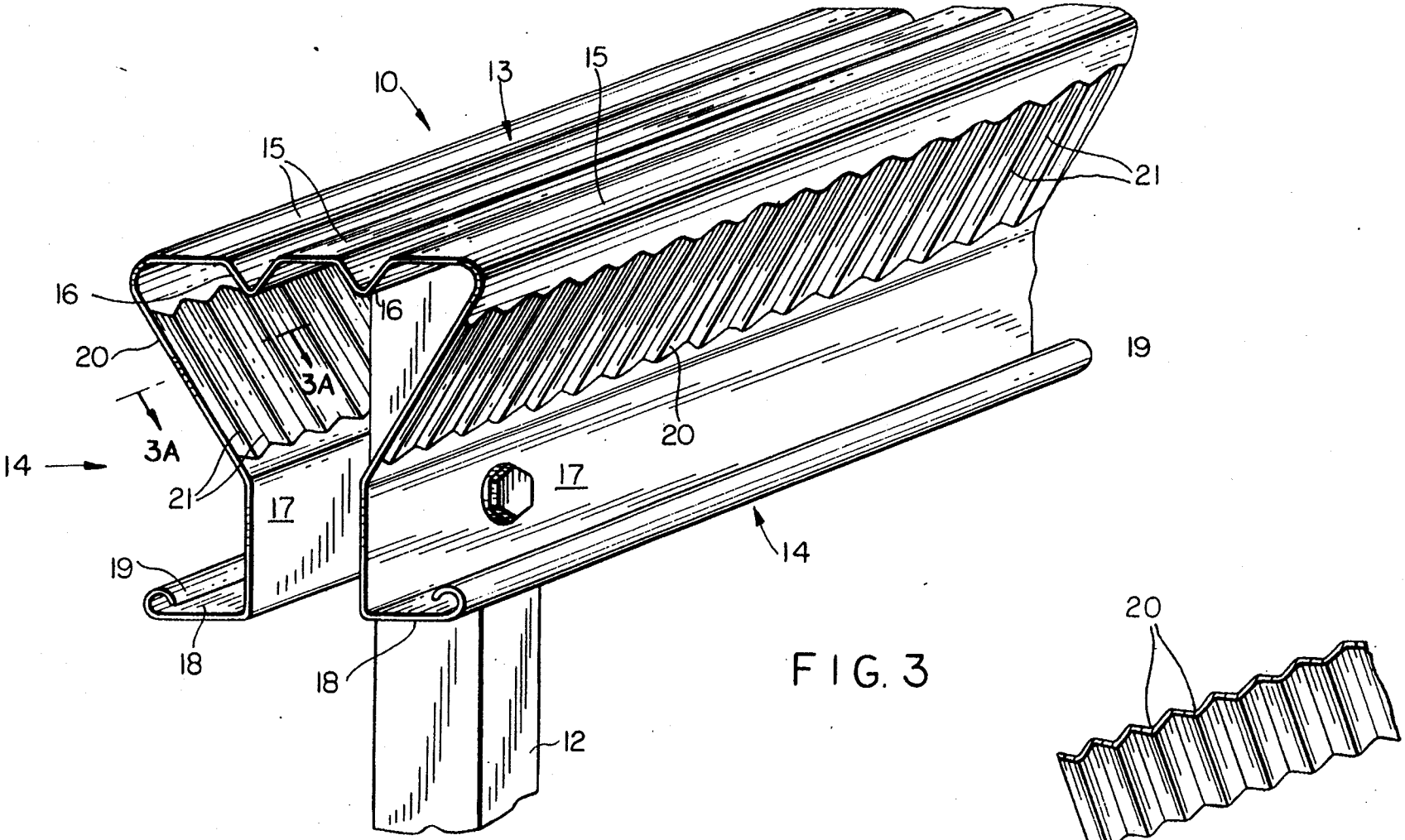
FIG. 3 is a schematic perspective view of a top chord member of a roof truss.
Figure 4:
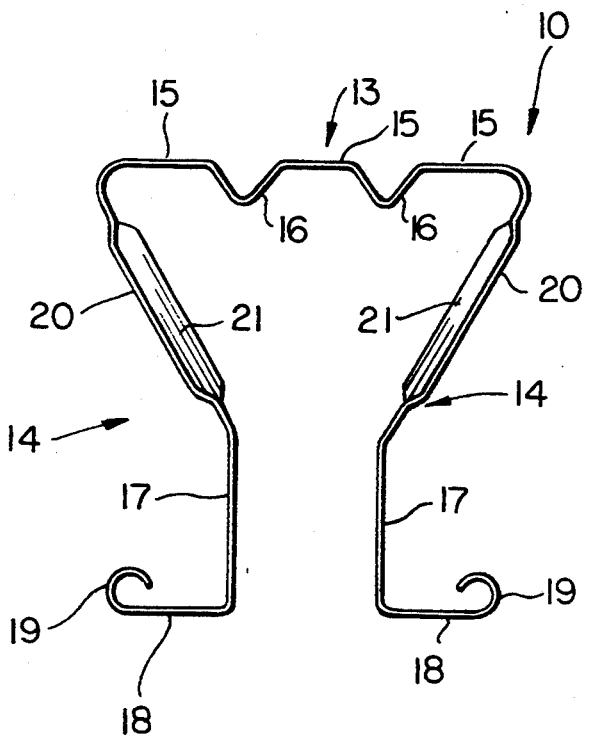
FIG. 4 is a schematic end elevation of the top chord of FIG. 3.

In FIG. 3 of the accompanying drawings there is schematically depicted the top chord 10. The top chord 10 is adapted to engage the web members 12 so as to transmit forces thereto. The top chord 10 has an upper web 13 which is longitudinally extending, and which joins to side flanges 14. The upper web 13 has planar faces 15 which are adapted to engage roof battens. There is also provided longitudinally extending reinforcing ribs 16.

The side flanges 14 each consist of a first flange portion 17 which extends longitudinally, and which both extend generally perpendicular to the web 13. The first flange portions 17 are spaced by a width which is less than the transverse width of the web 13. The distance between the first flange portions 17 is adapted to match the width of the web member 12 which is to be bolted thereto.

The side flanges are also provided with outwardly projecting flanges 18 which are provided with curved ends 19 for safety purposes.

The side flanges 14 have second flange portions 20 which are inclined to both the web 13 and the first flange portion 17, and converge from the web 13 toward the first flange portions 17. The second flange portions 20 are each corrugated so as to have corrugations 21 which extend in a direction from the web 13 toward the first flange portions 17.

The longitudinally extending ribs 16 increase the radius of gyration of the web 13, thus increasing its resistance to longitudinal buckling. The corrugations 21 also enlarge the radius of gyration of the side flanges 14 thereby increasing their resistance to buckling in a plane parallel to the second flange portions 20, when viewed in transverse cross section.

Figure 5:
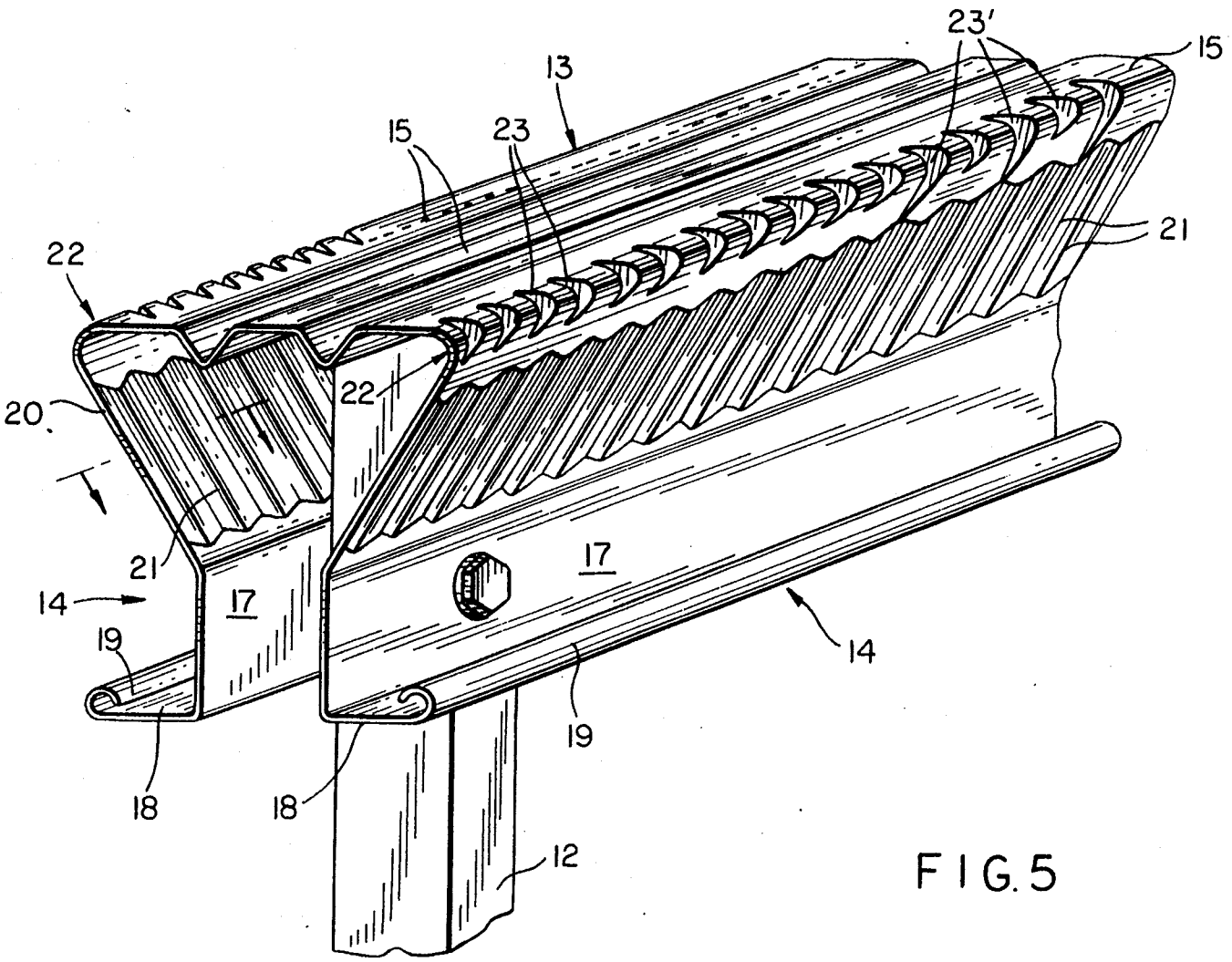
FIG. 5 is a schematic perspective view of a modification of the top chord of FIG. 3.

In FIG. 5 there is schematically depicted a modification of the chord 10 of FIG. 3. In this modification, the upper radius corners 22 are corrugated so as to have corrugations 23 which provide a plurality of inwardly projecting ridges. The corrugations 23 aid in strengthening the corners 22 to inhibit buckling. If so required, the corrugations 23' may extend further toward the corrugations 21 and in some instances as shown may actually overlap with respect thereto. Still further, if the corrugations 23' overlap with the corrugations 21 the overlapping portions of the corrugations 21 and 23' could be staggered along the length of the second flange portion 20.

The corrugations 23 may be spaced by 5 to 6 mm and preferably 5.5 mm. Preferably the corrugations 23 would have a depth of 1 to 4 mm but more preferably 1.5 mm.

I claim:

1. An upper chord of a roof truss, the chord formed of a rolled metal strip material having a cross section so that the beam has a longitudinally extending web, the web further comprising one or more longitudinal reinforcing ribs, a pair of parallel side flanges joined by said web, each side flange having a first flange portion which is generally perpendicular to said web, so that the two first flange portions are generally parallel and spaced by a distance less than the transverse width of the web, and a second flange portion which is inclined to both the web and the associated first flange portion, so that the second flange flanged portions converge away from said web toward the first flange portions, and wherein the second flanged portions are corrugated so as to provide a wave configuration with a plurality of ridges and troughs, which ridges and troughs each longitudinally extend in a direction from said web towards the associated first flange portion.

2. The chord of claim 1, wherein said second flange portions are connected to said web by arcuate corners, and said arcuate corners are formed with corrugations which are spaced at longitudinal positions along the beam.

3. The chord of claim 1, wherein the corner corrugations are spaced by a pitch of 5 to 6 mm and have a depth of 1 to 4 mm.

4. The chord of claim 3, wherein said corner corrugations are spaced by a pitch of 5.5 mm and are 1.5 mm in depth.

5. The chord of claim 4, wherein the corner corrugations overlap the corrugations of said second flange portions and are staggered with respect thereto.

6. The chord of claim 1, wherein each first flange portion has a longitudinal extremity remote from said web, which longitudinal extremities are rounded.

* * * * *